United States Patent [19]

Sellars

[11] 4,275,262

[45] Jun. 23, 1981

[54] SUBMARINE CABLE

[75] Inventor: Albert E. Sellars, Southampton, England

[73] Assignee: International Standard Electric Corporation, New York, N.Y.

[21] Appl. No.: 670,136

[22] Filed: Mar. 25, 1976

[30] Foreign Application Priority Data

Dec. 4, 1975 [GB] United Kingdom ..... 49824/75

[51] Int. Cl.[3] ..... H01B 5/10

[52] U.S. Cl. ..... 174/128 R; 174/107

[58] Field of Search ..... 174/107, 108, 126 R, 174/126 CP, 128 R, 130, 131 R

[56] References Cited

U.S. PATENT DOCUMENTS

| | | | |
|---|---|---|---|
| 2,212,700 | 8/1940 | Peterson et al. | 174/131 R |
| 2,849,526 | 8/1958 | Brockbank | 174/107 |
| 3,095,643 | 7/1963 | Cooke et al. | 174/107 X |
| 3,264,404 | 8/1966 | Trebby et al. | 174/131 R X |
| 3,324,233 | 6/1967 | Bryant | 174/131 R |

FOREIGN PATENT DOCUMENTS

| | | | |
|---|---|---|---|
| 351249 | 9/1972 | U.S.S.R. | 174/107 |

*Primary Examiner*—Arthur T. Grimley

*Attorney, Agent, or Firm*—Thomas L. Peterson

[57] ABSTRACT

A submarine cable has a central strength member comprising two layers of very high tensile steel wires embedded onto a central aluminium core. The inner conductor of the cable surrounds the steel wires. This arrangement reduces the weight of the cable, increases its conductivity, reduces the copper used and provides easier diametral control by swaging.

5 Claims, 1 Drawing Figure

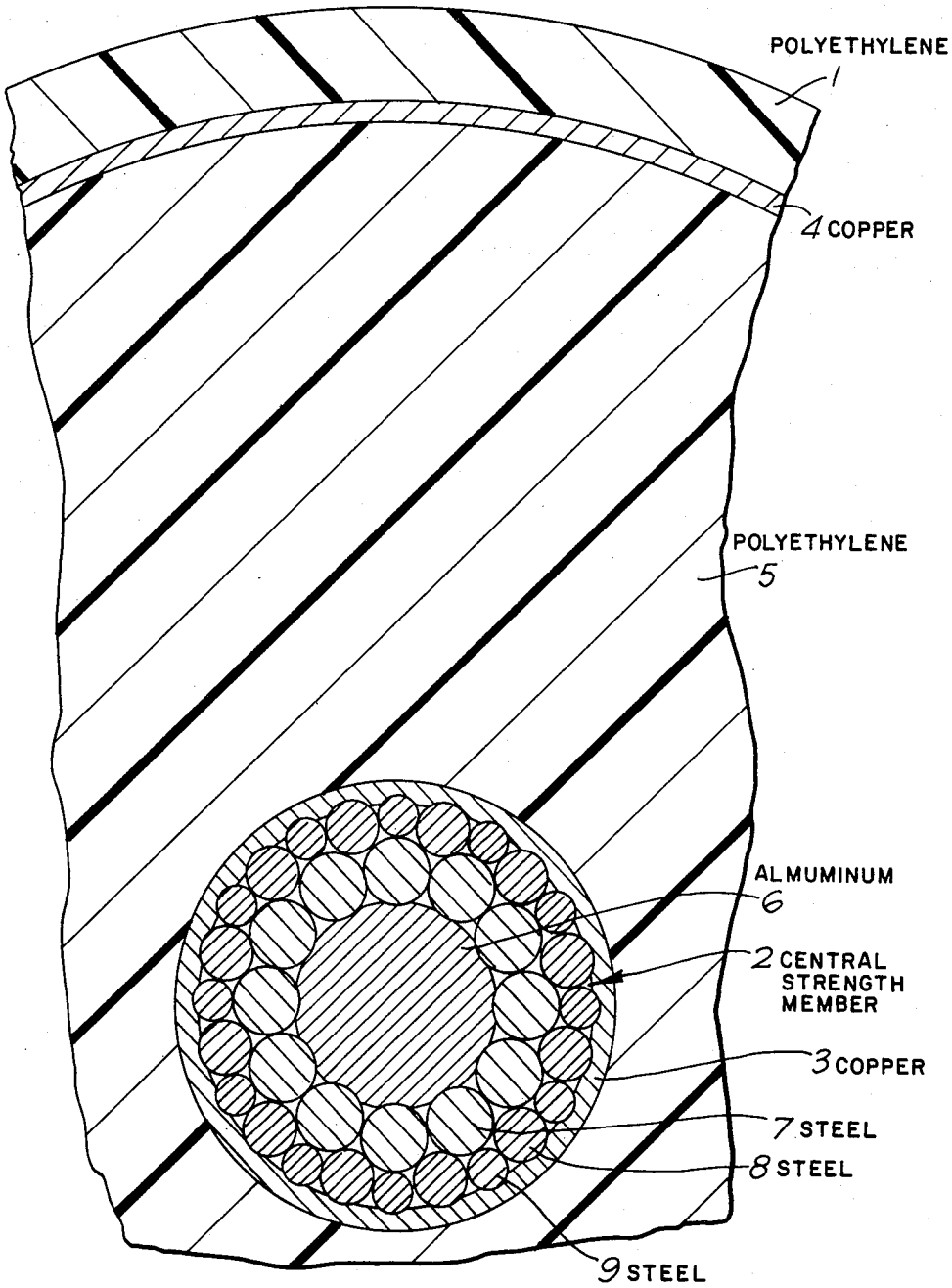
POLYETHYLENE
1
4 COPPER
POLYETHYLENE
5
ALMUMINUM
6
2 CENTRAL STRENGTH MEMBER
3 COPPER
7 STEEL
8 STEEL
9 STEEL

SUBMARINE CABLE

BACKGROUND OF THE INVENTION

This invention relates generally to a submarine cable and, more particularly, to an improved central strength member for such a cable.

A submarine cable basically consists of a central strength member with a surrounding inner conductor, in turn surrounded by plastic insulating material, in turn surrounded by an outer return conductor, the whole being sheated in a water impervious plastic sheath. This may be armoured with wire armouring for shallow water applications.

Generally, the central strength member comprises high tensile steel wires and the inner conductor comprises a copper tube embracing the wires. Similarly, the return conductor is normally a copper tube. In the inner conductor, the conductivity of the central strength members can be ignored to a large extent since their resistivity is high compared with that of copper.

It is an object of the present invention to modify the central strength member so as to decrease its weight and increase its conductivity and, thus, reduce the amount of copper required for the inner conductor.

SUMMARY OF THE INVENTION

According to the principal aspect of the present invention, there is provided a submarine cable comprising a water impervious sheath containing a central strength member, a radially inner tubular conductor surrounding the strength member, and a radially outer tubular conductor separated from the inner conductor by insulating material. The central strength member comprises a central, light weight, relatively highly conductive core, preferably of aluminium, surrounded by a plurality of strain members.

BRIEF DESCRIPTION OF THE DRAWING

The drawing is a fragmentary cross-section, on a much-enlarged scale, of a submarine cable according to an embodiment of the present invention.

DESCRIPTION OF THE PREFERRED EMBODIMENT

Referring to the drawing in detail, the cable of the invention comprises a water impervious sheath 1 made of extruded polyethylene and containing a central strength member, generally indicated by the reference numeral 2, a radially inner copper tubular conductor 3 surrounding the strength member, and a radially outer tubular copper conductor 4 separated from the inner conductor by extruded plastic insulating material 5, for example polyethylene.

The central strength member comprises a central aluminium core 6 closely surrounded by a first layer of high tensile steel wire strain members 7 which, in turn, are surrounded by a second layer of high tensile steel wire strain members 8 and 9.

In the particular embodiment described, the aluminium core 6 is just over 0.2 inches (prior to stranding), and each wire of the first layer of steel wires 7 has a diameter of just over 0.07 inches. The second layer of steel wires 8 and 9 comprises alternate wires 8 having a diameter of approximately 0.06 inches and alternate steel wires 9 having a diameter of just over 0.04 inches. The steel wires are all laid with the same lay. The effective thickness of the inner conductor 3 is approximately 0.02 inches. The outside diameter of the inner conductor is about 0.48 inches. The central strength member and inner conductor are shown in approximately the correct proportions in the drawing but the remainder of the cable is not necessarily.

The introduction of an aluminium core enables a reduction in the thickness of the inner conductor 3 from about .030 inches with previous cables. The loss of conductivity by the copper reduction is made up in excess by the improved conductivity of the central strength member by means of the aluminium core. This results in a reduction in the weight of the central strength member by about 18%. It is proposed to use very high tensile steel wires having a tensile strength in excess of 100 tons per square inch, preferably 130 tons per square inch. The outside diameter of the inner conductor is maintained at 0.478 inches which corresponds to earlier cables and the reduction in the thickness of the copper conductor permits a larger diameter of the central strength member. The tensile strength of the central strength member is approximately 13 tons in the embodiment described. The weight of the composite central conductor is reduced by 14.5% and the D. C. resistance per nautical mile has been reduced from about 0.9 ohms to about 0.8 ohms, a gain in conductivity of 12%. The improved conductivity can assist in reducing power feed voltages in a system and, therefore, reduce risks associated with high voltages.

Forming the central conductor and strength member in the manner described offers several advantages. Firstly, it enables a reduction in the amount of copper used. The thinner conductor can be satisfactorily swaged over the steel wires, because of the use of a greater number of, but smaller, wires in the outer layer than used on known cables adjacent to the inner conductor, but the effective wall thickness is not less than the thickness of the original copper strip from which the conductor is formed, by controlled tube reducing and swaging, after longitudinally seam welding. The swaging step partially embeds the copper into the outer layer of steel wires and the inner layer of steel wires is embedded into the aluminium center core when the steel strands and aluminium are drawn through a die prior to applying the copper inner conductor. The steel wires themselves do not become swaged to a shape other than their original circular configuration, because they are too hard, but the aluminium core becomes deformed. Further, this softness of the aluminium center core enables easy and accurate control of the outer diameter of the central strength member. The aluminium preferred is half-hard electrical grade 99.5% aluminium. It would have a breaking strain of about 500 lbs. and so there is no problem in laying up such a wire with the much stronger steel wires. Secondly, it provides a lighter overall cable which makes handling easier.

The dimensions disclosed herein are given by way of example only, and not by limitation.

An aluminium alloy can also be used for the centre core, preferably containing 0.65% iron and known as "TRIPLE-E" alloy as made by Southwire Company.

What is claimed is:

1. A submarine cable comprising:

a water impervious sheath containing a central strength member, a radially inner tubular copper conductor surrounding the strength member, and a radially outer tubular conductor separated from the inner conductor by insulating material;

said central strength member comprising a central aluminum core surrounded by a plurality of strain members;

said strain members comprising first and second layers of steel wires, said first layer being contiguous with said aluminum core and said second layer surrounding and contiguous with said first layer, said wires of said second layer being of smaller diameter than that of the wires of said first layer;

said second layer comprising wires of two different sizes laid adjacent to one another and alternately large and small proceeding circumferentially around the cable axis; and said aluminum core having a diameter at least twice that of any of said wires.

2. A submarine cable comprising:

a water impervious sheath containing a central strength member, a radially inner tubular copper conductor surrounding the strength member, and a radially outer tubular conductor separated from the inner conductor by insulating material;

said central strength member comprising a central aluminum core surrounded by a plurality of strain members;

said strain members comprising at least one layer of steel wires contiguous with said aluminum core;

said wires being partially embedded in said aluminum core; and said aluminum core having a diameter at least twice that of any of said wires.

3. A submarine cable comprising:

a water impervious sheath containing a central strength member, a radially inner tubular copper conductor surrounding the strength member, and a radially outer tubular conductor separated from the inner conductor by insulating material;

said central strength member comprising a central aluminum core surrounded by a plurality of strain members;

said strain members comprising first and second layers of steel wires, said first layer being contiguous with said aluminum core and said second layer surrounding and contiguous with said first layer, said wires of said second layer being of smaller diameter than that of the wires of said first layer;

said wires of said first layer being partially embedded in said aluminum core;

said wires of said second layer being partially embedded in said inner tubular conductor; and said aluminum core having a diameter at least twice that of any of said wires.

4. A submarine cable comprising:

a water impervious sheath containing a central strength member, a radially inner tubular copper conductor surrounding the strength member, and a radially outer tubular conductor separated from the inner conductor by insulating material;

said central strength member comprising a central aluminum core surrounded by a plurality of strain members;

said strain members comprising at least one layer of steel wires contiguous with said aluminum core;

said aluminum core having a diameter at least twice that of any of said wires;

A:B:C=20:7:2 where:

A is the diameter of said core;

B is the diameter of each said wire; and

C is the effective thickness of said inner conductor.

5. A cable as set forth in claim 3 wherein:

A:B:C:D:E=20:7:2:6:4 where:

A is the diameter of said core;

B is the diameter of each said wire of said first-mentioned layer;

C is the effective thickness of said inner conductor;

D is the diameter of the larger wires of said second layer; and

E is the diameter of the smaller wires of said second layer.

* * * * *